United States Patent [19]

Dielman

[11] 3,999,353

[45] Dec. 28, 1976

[54] REVERSIBLE PILASTER SHOES

[75] Inventor: Harold J. Dielman, Lyndhurst, Ohio

[73] Assignee: The Sanymetal Products Co., Inc., Cleveland, Ohio

[22] Filed: Mar. 7, 1975

[21] Appl. No.: 556,334

Related U.S. Application Data

[63] Continuation of Ser. No. 412,276, Nov. 2, 1973, abandoned.

[52] U.S. Cl. ..... 52/731; 52/122; 52/239; 52/728

[51] Int. Cl.[2] ..... E04C 3/32; E04B 2/56

[58] Field of Search ..... 52/122, 239, 242, 290, 52/725, 728, 241, 247, 264, 238, 731; 126/314, 315, 317; 240/87

[56] References Cited

UNITED STATES PATENTS

| | | | |
|---|---|---|---|
| 574,641 | 1/1897 | Streator | 52/728 X |
| 709,220 | 9/1902 | Houlihan | 126/317 |
| 1,278,895 | 9/1918 | Farley | 126/317 |
| 1,304,013 | 5/1919 | Betz | 52/239 X |
| 1,542,480 | 6/1925 | Scruggs | 126/314 |
| 1,619,385 | 3/1927 | Wallace | 126/317 |
| 1,954,845 | 4/1934 | Schille | 126/317 |
| 1,983,850 | 12/1934 | Gordon | 52/728 X |
| 2,053,555 | 9/1936 | Hall | 126/314 |
| 2,058,135 | 10/1936 | Colville | 52/725 X |
| 2,159,539 | 5/1939 | Klein | 126/314 |
| 2,240,483 | 5/1941 | Anderson | 52/264 X |
| 2,287,079 | 6/1942 | Anderson | 52/239 |
| 2,897,553 | 8/1959 | Gorrow | 52/728 X |
| 3,053,354 | 9/1962 | Dielman | 52/122 |
| 3,108,664 | 10/1963 | Vawter | 52/239 X |
| 3,194,362 | 7/1965 | Wargo | 52/122 |
| 3,308,808 | 3/1967 | Malafouris | 126/314 |
| 3,793,794 | 2/1974 | Archer et al. | 52/725 X |

FOREIGN PATENTS OR APPLICATIONS

| | | | |
|---|---|---|---|
| 297,564 | 5/1931 | Italy | 52/728 |

OTHER PUBLICATIONS

Weis, "Compartments" Sweets' Catalogue 22/b/we, p. 13, 1962, copy in Design Library.

*Primary Examiner*—Frank L. Abbott
*Assistant Examiner*—Leslie A. Braun
*Attorney, Agent, or Firm*—Meyer, Tilberry & Body

[57] ABSTRACT

A pilaster footing comprises a substantially rectangular cross section channel member open at both ends. One end opening of the channel member conforms to the channel cross section and is substantially rectangular. The other end opening is partially closed by peripheral skirts which provide a non-rectangular configured opening.

5 Claims, 4 Drawing Figures

30
18
22
10
26
16a
20
24
14
16
12
28
34
3.
32
32a
35
36
42
46
43
48
50
52
54
38
40
44

REVERSIBLE PILASTER SHOES

This is a continuation of application Ser. No. 412,276 filed Nov. 2, 1973, now abandoned.

The present invention is concerned with shoe fittings for pilasters and is more particularly concerned with a pilaster shoe fitting employed as a decorative and protective fitting for pilasters employed as part of interior wall partitions, space dividers, shelving supports and the like.

The construction of lavatory privacy panels, office dividers, and interior room partitions of every description, utilize panels made of a suitable material such as glass, plastic or steel, which panels are supported on pilasters. As the term is used in this specification and in the claims, a "pilaster" may be described as a substantially vertical column or pier, usually of generally rectangular cross section, which is mounted and secured in a vertical, upright position to support vertically positioned panels. Such panels are usually employed to form a space divider or interior wall. Naturally, they may be put to any desired use, to hold shelves, displays, etc. Generally, such pilasters are between about five to eight feet high, and a standard cross section is about 1¼ × 3 inches. Obviously, the pilasters may be of any desired or required size, and the invention is applicable to any size pilaster and shoes therefor.

It is known in the art to fasten such pilasters by means of bolts inserted into the floor, and to provide a small clip or other securing means at the floor level to engage a pilaster shoe within which the bottom of the pilaster is encased. The shoe is generally a short section of rectangular cross section channel which is slipped over the pilaster and fastened at the floor level to provide a decorative and protective member thereabout.

The pilaster shoe serves to cover from view the bottom portion of the pilaster as well as the bolts or other securing means which secure the pilaster to the floor. The shoe also provides a protective function by protecting the pilaster, which usually has a decorative finish, from marking or scratching by floor cleaning machines, by the detergents and waxes used to clean and wax the floors, by scuffing by the feet of passerbys, etc.

Normally, the shoe encases the entire periphery of the pilaster. However, in some cases, such as where the panels extend all the way to the floor, it may be desired and possible to encase only, say, three sides of a rectangular pilaster. In such case, the shoe would be formed from a section of open, U-shape cross section channel.

In order to provide an attractive and neat looking shoe, the pilaster cross section should substantially fill the top opening of the shoe. Accordingly, it is the known practice to utilize a different shaped shoe for each shape pilaster employed. For example, rectangular pilasters require a shoe which has a rectangular opening. Pilasters with rounded edges or beaded edges, which are commonly employed shapes, require shoes with a correspondingly shaped opening.

It is an object of the present invention to provide a pilaster shoe which is reversible, and whose opposite end openings provide different configured openings to receive different cross-sectional shaped pilasters.

In accordance with the present invention, there is provided a pilaster shoe comprising a channel member section having a pilaster-receiving opening at each end thereof, the cross-sectional configuration of the two openings differing one from the other.

In accordance with one aspect of the invention, one of the two pilaster receiving openings substantially conforms to the cross section of the channel member, while the cross-sectional configuration of the other pilaster receiving opening is formed at least in part by extension skirts disposed substantially within and parallel to the plane of the opening, and supported from the channel sidewalls.

As the term is used in this specification and in the claims, the term "channel" means any open or closed hollow member, such as, for example, one which is U-shaped in cross section (an open channel), one which is O-shaped in cross section (a closed channel, i.e., a tube) or one which is polygonal in cross section (a closed channel, i.e., a duct).

The invention may be better understood by considering the following detailed description of a preferred embodiment thereof, which is intended to illustrate but not limit the invention. The preferred embodiment is illustrated in the attached drawings wherein.

Figures 1, 2, 3, 4:
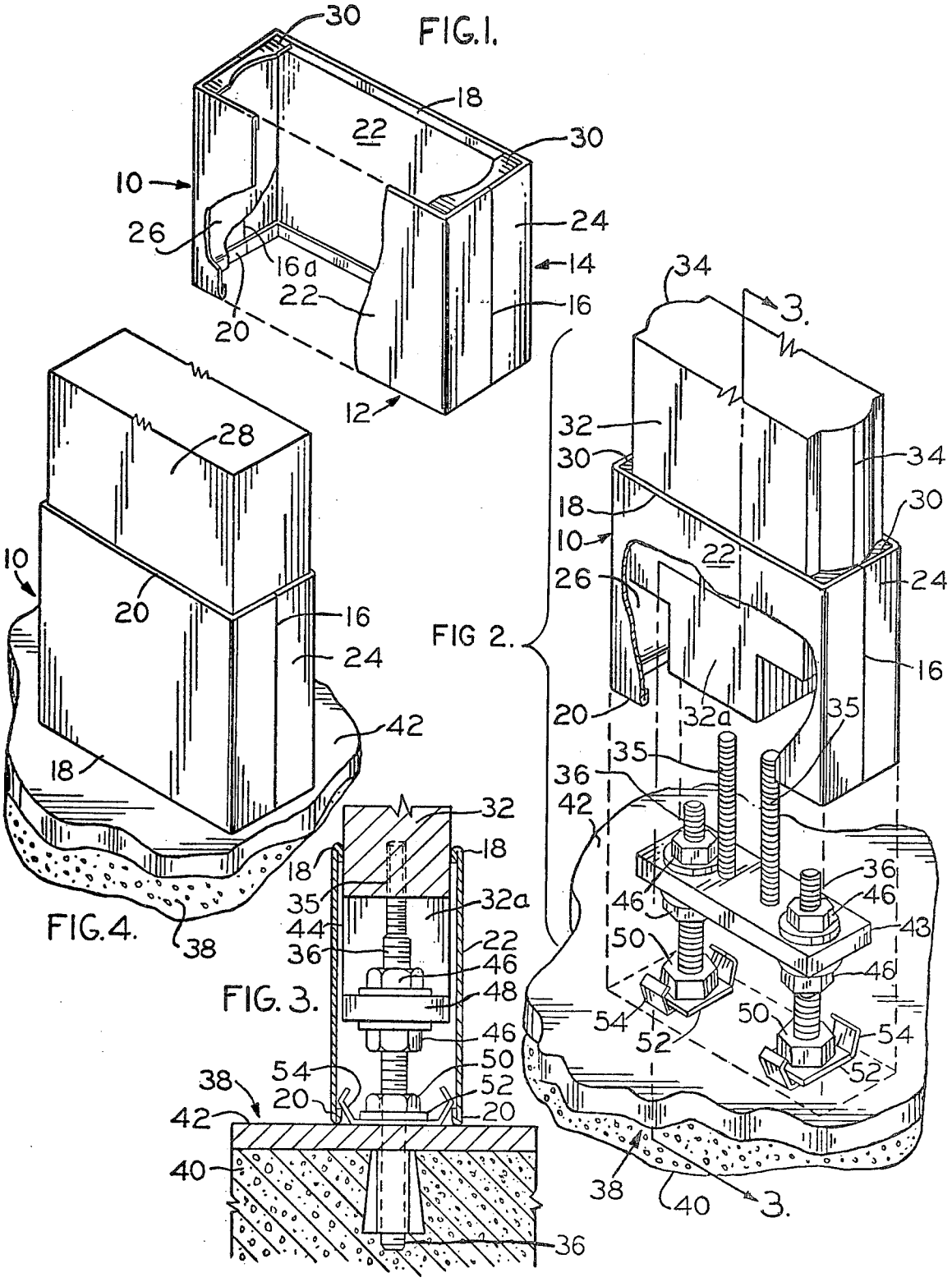
FIG. 1 is a perspective view, partially broken away, of a pilaster shoe in accordance with the present invention.
FIG. 2 is an exploded perspective view, partially broken away, showing a beaded edge pilaster with the shoe of FIG. 1 mounted thereon and pilaster anchoring means.
FIG. 3 is an unexploded section view in elevation taken along line 3—3 of FIG. 2; and, FIG. 4 is a view of the shoe of FIG. 1 mounted on a rectangular pilaster, with the shoe in a position which is reversed as compared to the position shown in FIG. 3.

Referring now to the drawings, FIG. 1 shows a shoe in accordance with the invention, generally indicated at 10. The shoe comprises a segment of a hollow closed channel formed by joining two open U-shaped sections 12 and 14 along the length of their turned-up edges at seams 16 and 16*a*.

The channel 10 is turned-back along the entire periphery of its upper opening (as viewed in FIG. 1) to form a first shoulder 18. Similarly, the entire periphery of the lower opening (as viewed in FIG. 1) of the column is turned back along its length to form a second shoulder 20.

Each of the U-shaped sections 12 and 14 is a channel member, and the hollow closed channel formed in the above manner has wide sidewalls 22 defined by the webs of the channel members and narrow sidewalls 24 each defined by corresponding side flanges of the channel members. On the interior of each of short sidewalls 24 a joining strip or plate member 26 is fastened in any suitable manner. A convenient method is to spot weld each of U-shaped sections 12 and 14 at their opposite ends to the pair of joining strips 26.

Each of joining strips or plate members 26 has one end thereof turned inwardly of the closed channel to form a pair of opposed skirts or flanges 30. Skirts or flanges 30 may obviously have any desired configuration and it will be noted that in the case of the embodiment of FIG. 1, the shape of the skirts 30 is complementary to the cross-sectional shape of the narrow sides of the pilaster 32 illustrated in FIG. 2.

Referring now to FIG. 2, the shoe 10 of FIG. 1 is shown engaged with one end of a pilaster 32. Pilaster 32 is substantially rectangular in cross section except that the narrow sides thereof are beaded, the bead being formed in cross section in shape of an arcuate lip 34. The lower end of pilaster 32 has a rectangular notch cut from each side thereof to form a tongue 32*a* extending therefrom. It should be noted that the particular shape or outline in cross section of the pilaster forms no part of the present invention, pilasters conventionally being produced in a number of cross-sectional shapes including those illustrated in the drawings. The cross-sectional profile of the pilaster does, however, determine the configuration required of skirts or flanges 30.

Still referring to FIG. 2, a pair of anchor bolts 36 are embedded within a floor 38 consisting of a structural member 40 with a wear surface 42 thereon. A support bar 48 is mounted horizontally upon anchor bolts 36 held in place thereon by washers and nuts 46 threaded onto anchor bolts 36. Fastening bolts 35 are secured through the support bar 48 with the shaft of fastening bolts 35 projecting upwardly. As best seen in FIG. 3, which is an assembled view, fastening bolts 35 extend through tongue 32*a* and into the main body portion of pilaster 32 to securely fasten pilaster 32 to support bar 48.

In FIG. 3, that portion of fastening bolts 35 which extends through tongue 32*a* is shown in dotted outline and that portion which extends through the main body of pilaster 32 is shown in full view.

As seen in FIG. 3, each of anchor bolts 36 extends into and is embedded within structural member 40 so that anchor bolts 36 and support bar 48 are firmly secured to floor 38 to provide rigid, anchoring support for pilaster 32.

Referring jointly to FIGS. 2 and 3, nuts 50 are threaded onto the portion of anchor bolts 36 immediately above wear surface 42 and cooperate with square washers 52 to bear upon shoe clips 54 to hold them securely in place against wear surface 42 of floor 38. It will be understood that this system of anchoring the lower ends of pilasters to a floor is conventional in the art. However, as described below, the size of the hardware associated with anchor bolts 36 must be such as to provide sufficient clearance for skirts 30 of pilaster shoe 10 when assembling the shoe to the pilaster.

Referring now particularly to FIG. 3, pilaster 32 is shown fitted in place over anchor bolts 36, the bottom end of pilaster tongue 32*a* bearing on support bar 48 and secured thereto by fastening bolts 35.

Pilaster shoe 10 is slipped down over shoe slips 54 which are resilient and bend inwardly as shoulders 20 pass thereover. As shoulders 20 pass below shoe clips 54, shoe clips 54 spring back into place, thus snap-securing shoe 10 in place.

As best seen in FIG. 2, skirts 30 complement the shape of arcuate lip 34 and provide a neat, finished appearance to the installation.

Referring now to FIG. 4, a second pilaster 28 of rectangular cross section is shown inserted into shoe 10. In this case, shoe 10 is in a position which is upside down relative to the position illustrated in FIGS. 1, 2 and 3. That is, shoulder 20 is now the top shoulder and shoulder 18 is now the bottom shoulder. The opening formed by shoulder 20 is rectangular in cross section and complements the rectangular section of second pilaster 28. Anchor bolts 36 and their associated hardware, particularly support bar 48, are positioned and sized so as to provide sufficient clearance for the skirts 30 so there is no interference with skirts 30 when shoe 10 is positioned with shoulders 18 on floor wear surface 42. Obviously, support bar 48 must be sorter than the clearance available between skirts 30.

Thus, simply by reversing its position, shoe 10 may accommodate two different cross section shaped pilasters. The number of different shoes which must be carried in stock is thus halved.

Obviously, the two openings formed, respectively, by shoulders 18 and 20 may have any desired cross section shape. Both ends may be provided with skirts 30 of suitable, different configuration. Normally, since standard pilasters come in rectangular cross section (usually plastic laminated pilasters) and an arcuate lip beaded edge cross section (usually steel pilasters) the two shapes shown are preferred.

The invention in general terms however, comprises a shoe section having different cross section openings formed at its respective ends by the utilization of skirts at one or both ends to provide different cross section opening configurations at the respective ends.

It will be apparent that after reading and understanding the foregoing, many modifications and alterations to embodiments of the invention will occur to those skilled in the art. It is intended to include all such modifications and alterations within the scope of the attached claims.

What is claimed is:

1. A reversible pilaster shoe comprising, a rectangular tube of sheet material having an axis and opposite ends, said tube having first and second opposed pairs of planar side walls extending parallel to said axis and between said ends, said first and second opposed pairs of side walls at one of said opposite ends of said tube defining a first pilaster receiving opening having a rectangular contour transverse to said axis, and a pair of opposed flanges at the other of said opposite ends of said tube, each of said flanges projecting radially inwardly of said tube from a corresponding one of said second opposed pairs of side walls and extending laterally between and terminating adjacent said first opposed pair of side walls, said pair of opposed flanges further having opposed inner edges radially spaced apart from one another, at least a portion of each of said opposed inner edges having a like curvature concave with respect to said tube axis, said opposed inner edges of said pair of flanges and the side walls of said first opposed pair of side walls defining a second pilaster receiving opening at said other of said opposite ends of said tube having a contour transverse to said axis which is geometrically different from said rectangular contour of said first pilaster receiving opening.

2. The reversible pilaster shoe according to claim 1, wherein each of said flanges is a plate member in said tube attached to said corresponding one of said first opposed pair of side walls.

3. The reversible pilaster shoe according to claim 1, wherein said rectangular tube is comprised of a pair of opposed U-shaped channel members, said opposed channel members having webs providing said first opposed pair of side walls of said tube, said channel members further having coplanar abutting pairs of side flanges providing said second opposed pair of side walls of said tube, a pair of plate members within said tube, each said plate member having a first portion overlying and attached to a corresponding one of said pairs of side flanges to connect said channel members together, and each said plate member having a second portion extending radially inwardly of said tube from said first portion, said second portions of said plate members providing said pair of opposed flanges at said other of said opposite ends of said tube.

4. The reversible pilaster shoe according to claim 3, wherein said webs of said channel members each include a web flange at said other end of said tube, said web flanges each extending axially inwardly of said tube and facially overlying the corresponding web, each web flange extending laterally between the side flanges of the corresponding channel member, said second portions of said plate members each having opposite side edges engaging the corresponding one of said web flanges.

5. The reversible pilaster shoe according to claim 4, wherein said webs and abutting pairs of side flanges of said channel members at said one end of said tube each include a flange extending axially inwardly of said tube and facially overlying the corresponding one of the webs and side flanges of said channel members.

* * * * *